US008752838B2

(12) United States Patent
Weingardt et al.

(10) Patent No.: US 8,752,838 B2
(45) Date of Patent: Jun. 17, 2014

(54) VIDEO BINGO GAME AND METHOD THEREFOR

(75) Inventors: Gary Weingardt, Las Vegas, NV (US); Gamin Weingardt, Las Vegas, NV (US); Gary Lee Loebig, Austin, TX (US)

(73) Assignee: MPBingo LLC, Las Vegas, NV (US)

( * ) Notice: Subject to any disclaimer, the term of this patent is extended or adjusted under 35 U.S.C. 154(b) by 111 days.

(21) Appl. No.: 13/495,259

(22) Filed: Jun. 13, 2012

(65) Prior Publication Data

US 2013/0053121 A1 Feb. 28, 2013

Related U.S. Application Data

(63) Continuation-in-part of application No. 09/949,311, filed on Sep. 7, 2001, now Pat. No. 8,201,827, which is a continuation-in-part of application No. 09/745,706, filed on Dec. 26, 2000, now Pat. No. 6,565,091.

(51) Int. Cl.
*A63F 3/06* (2006.01)

(52) U.S. Cl.
USPC ..... 273/269; 463/19

(58) Field of Classification Search
USPC ..... 273/269, 274, 299; 463/13, 16–19
See application file for complete search history.

(56) References Cited

U.S. PATENT DOCUMENTS 4,364,567 A * 12/1982 Goott ..... 273/237
4,861,041 A * 8/1989 Jones et al. ..... 273/292
5,265,880 A * 11/1993 Maksymec ..... 273/269
5,393,057 A * 2/1995 Marnell, II ..... 463/13
5,494,293 A * 2/1996 Goldfarb ..... 273/269
5,647,798 A * 7/1997 Falciglia ..... 463/19
6,079,711 A * 6/2000 Wei et al. ..... 273/269
6,183,361 B1 * 2/2001 Cummings et al. ..... 463/18
6,656,044 B1 * 12/2003 Lewis ..... 463/19
6,702,668 B2 * 3/2004 Banyai ..... 463/17
7,066,812 B2 * 6/2006 Fried et al. ..... 463/19
7,464,933 B2 * 12/2008 Peters et al. ..... 273/269
7,481,706 B2 * 1/2009 Dodge ..... 463/18
7,712,742 B1 * 5/2010 Russell ..... 273/269
7,717,785 B2 * 5/2010 Odom ..... 463/19
7,753,774 B2 * 7/2010 Gail et al. ..... 463/20
7,850,518 B2 * 12/2010 Walker et al. ..... 463/17
7,997,581 B2 * 8/2011 Brennan ..... 273/269
8,057,292 B2 * 11/2011 Gail et al. ..... 463/19
8,298,061 B2 * 10/2012 DeLise ..... 463/17
2002/0113369 A1 * 8/2002 Weingardt ..... 273/269
2004/0173965 A1 * 9/2004 Stanek ..... 273/269
2005/0280210 A1 * 12/2005 Harrison ..... 273/269

* cited by examiner

*Primary Examiner* — William Pierce
(74) *Attorney, Agent, or Firm* — Weiss & Moy, P.C.; Jeffrey D. Moy

(57) ABSTRACT

A video bingo poker game comprising: providing each player with an individual flashboard, each flashboard having an equal number of spaces, each space defined by a column label and a space number, wherein the space number is randomly selected from a predefined number range for each column; providing a plurality of bingo balls, wherein each bingo ball has markings associated with one of the plurality of spaces; randomly selecting a first group of bingo balls; displaying to each player the markings associated with each selected bingo ball of the first group of bingo balls; marking each square associated with each of the first group of bingo balls on each individual flashcard; and determining any winning flashboard.

16 Claims, 9 Drawing Sheets

| | | | | | |
|---|---|---|---|---|---|
| ROYAL FLUSH | 250 | 500 | 750 | 1000 | 4000 |
| STRAIGHT FLUSH | 50 | 100 | 150 | 200 | 250 |
| 4 OF A KIND | 25 | 50 | 75 | 100 | 125 |
| FULL HOUSE | 8 | 16 | 24 | 32 | 40 |
| FLUSH | 5 | 10 | 15 | 20 | 25 |
| STRAIGHT | 4 | 8 | 12 | 16 | 20 |
| 3 OF A KIND | 3 | 6 | 9 | 12 | 15 |
| TWO PAIR | 2 | 4 | 6 | 8 | 10 |
| JACKS OR BETTER | 1 | 2 | 3 | 4 | 5 |

VIDEO BINGO GAME AND METHOD THEREFOR

RELATED APPLICATIONS

This is a continuation-in-part of U.S. patent application Ser. No. 09/949,311, filed Sep. 7, 2001 now U.S. Pat. No. 8,201,827 which is a continuation-in-part of U.S. patent application Ser. No. 09/745,706, filed Dec. 26, 2000 now U.S. Pat. No. 6,565,091 in the name of the Applicant, to which priority is claimed.

BACKGROUND

This invention relates generally to bingo games, and more particularly to a video bingo game and method that utilizes bingo rules to present video games having the look and feel of video poker and slot games, and that preferably utilize multiple ball draws to provide a pace of play beneficial to fast and slow players alike.

The rules of play for conventional bingo are well-known. Players receive individual game cards, generally featuring a matrix of five rows and five columns. The columns are lettered B I N G O from left to right across the top of the matrix and each bingo card has five numbers in each row, except for the center I column which has a "free space" at the intersection of the third row and the third column.

Bingo balls individually numbered 1-75 are mixed together and balls are selected one at a time. As each ball is selected, the number is announced to the players, who cover any corresponding number on their bingo card. When a player achieves a predetermined arrangement of covered spots on his bingo card, that player yells out "Bingo!" or hits the bingo button and he wins the game.

Bingo is increasingly being played in electronic form. Players operate linked machines that display one or more bingo cards. Numbers are called by live ball draw, or a bonanza game and the called numbers are daubed on the player cards on each linked machine. Each game is played until a winning card on at least one linked machine is produced, after which another game may be started.

But there are a number of drawbacks associated with prior art electronic bingo games. Many players prefer the fast action of video poker and slot machines to relatively slower traditional bingo games. Such players will tend to avoid electronic bingo games entirely, in favor of competing games.

Moreover, even for those who prefer to play bingo, prior art video bingo games are not entirely satisfactory. One drawback is timing. Depending on the player, the game may be too fast or too slow. Thus, each game will have a single ball draw and a time limit, perhaps in the range of about 20 seconds. A fast player might be able in significantly less than the allotted time to complete his or her selections and be ready to play the next game—only to be forced to wait until the game has closed and the next one begun with another ball draw. After a series of games, a player who is required to spend a significant time waiting may well opt to leave the machine and choose a faster-paced game.

On the other hand, a slower player might find that he or she cannot make the required selections in time, with the result that the game closes before they have finished. Players who cannot finish the game in the allotted time can also be expected to lose interest.

A need therefore existed for an electronic bingo game having the look and feel of a non-bingo game, including for example video poker or video slots (sometimes also referred to as "fruit machines"). A need further existed for an electronic bingo game that accommodates the play habits of both fast and slow players. The present invention satisfies these needs and provides other, related, advantages.

SUMMARY OF THE INVENTION

It is an object of the present invention to provide an electronic bingo game and method having the look and feel of a non-bingo game, including for example video poker or video slot machines.

It is a further object of the present invention to provide an electronic bingo game and method that accommodates the play habits of both fast and slow players.

It is a still further object of the present invention to provide a bingo game and method that provides a "near-miss" or "case" bingo reward or the like to provide a payout, in addition to the normal slot payouts as reflected on a pay table, and further that provides a progressive jackpot for case bingos.

Other objects, features and advantages of the present invention will become apparent from a consideration of the following detailed description.

BRIEF DESCRIPTION OF THE PREFERRED EMBODIMENTS

A video bingo poker game comprising: providing each player with an individual flashboard, each flashboard having an equal number of spaces, each space defined by a column label and a space number, wherein the space number is randomly selected from a predefined number range for each column; providing a plurality of bingo balls, wherein each bingo ball has markings associated with one of the plurality of spaces; randomly selecting a first group of bingo balls; displaying to each player the markings associated with each selected bingo ball of the first group of bingo balls; marking each square associated with each of the first group of bingo balls on each individual flashcard; and determining any winning flashboard.

The features, functions, and advantages can be achieved independently in various embodiments of the disclosure or may be combined in yet other embodiments.

BRIEF DESCRIPTION OF THE DRAWINGS

Embodiments of the disclosure will become more fully understood from the detailed description and the accompanying drawings, wherein.

DETAILED DESCRIPTION

Referring first to FIGS. 1-4, an embodiment of the bingo game of the present invention having the look and feel of video poker is shown. For ease of reference, this game will be referred to as "Bingo Poker" herein.

Figure 4:
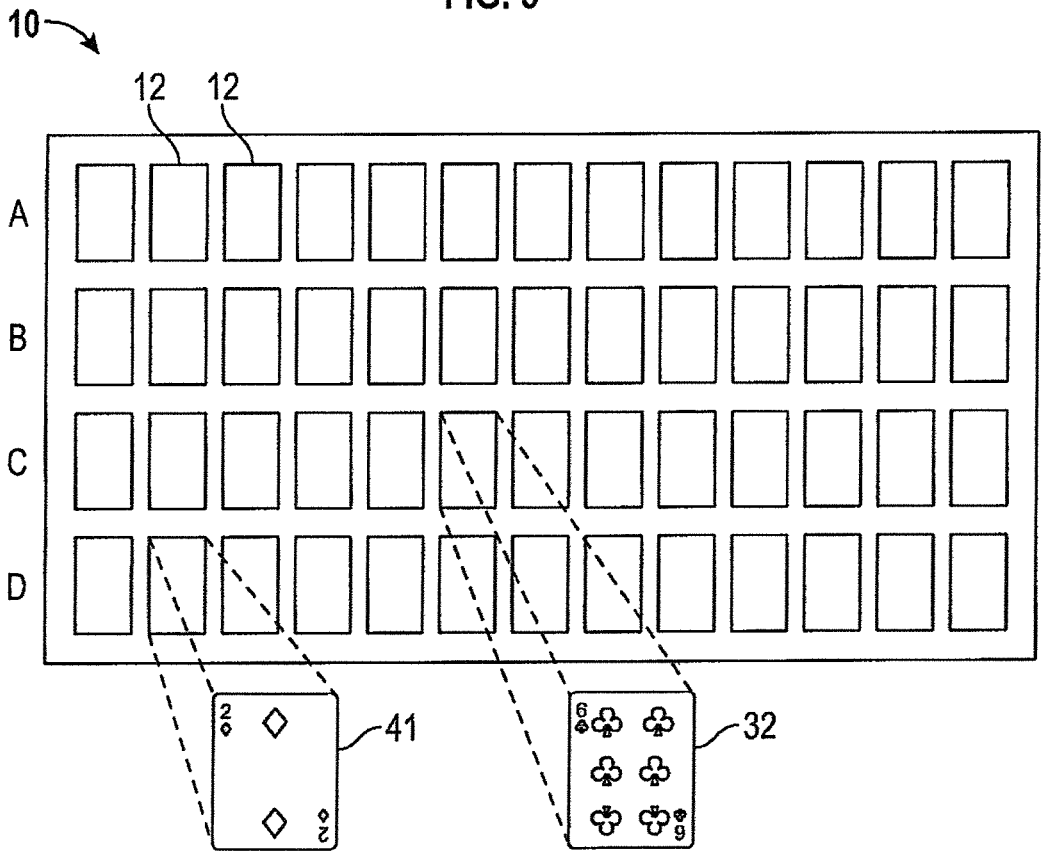
FIG. 4 shows a flashboard component of an embodiment of a bingo game of the present invention, with two flashboard squares shown in detail.

Referring first to FIG. 4, each player is provided with a flashboard/bingo card 10 (hereinafter "flashboard 10"). The flashboard 10 may optionally be displayed to the player on a video screen, or may simply be provided to the game terminal but not displayed. In order to provide a less cluttered appearance, and to enhance the poker-like look of the game, it will be preferred to not display the flashboard 10 on the gaming machine screen.

In its preferred configuration, the flashboard 10 contains a plurality of individual squares 12. Each square 12 is intended to correspond to a particular numbered ball used in the game, with the total number of squares corresponding to the total number of numbered balls used. As shown in FIG. 4, in this embodiment, there are 52 squares 12, corresponding to 52 balls. As will be discussed below, it will be possible to vary the number of squares 12 and balls, and indeed, it would be possible to provide a noncorresponding number of squares 12 and balls.

It should be noted further that if the flashboard 10 is to be displayed to the player, the configuration shown in FIG. 4—having four rows of thirteen squares each, with, reading from left to right, row A having squares 1-13, row B having squares 14-26, row C having squares 27-39, and row D having squares 40-52—is only one of many that would be possible. Thus, it would be possible to organize the squares 12 into any desired combination of rows and columns or other display arrangement.

Preferably, each individual square 12 has assigned thereto appropriate indicia corresponding to the specific game that is to be played. For Bingo Poker, the indicia will comprise suit and value indicia commonly displayed on playing cards. For example, as shown in FIG. 4, square 32 has been assigned as its suit and value indicia the six of clubs. Square 41 has been assigned as its suit and value indicia the two of diamonds. In a Bingo Poker game that utilizes 52 balls and thus at least 52 squares 12, each square 12 will have different suit and value indicia, so that each card in a 52 card deck is represented in a different square 12.

While, in this embodiment, the indicia used correspond to that displayed on playing cards, it should be understood that indicia from other card-type games could be used, and the game played according to rules for such card-type game.

The suit and value indicia may be randomly generated on each square 12 of each flashboard 10 before each game. Alternatively, different flashboards 10 may be created before play is begun by the players depressing an appropriate button/key or otherwise commanding the player machine to generate randomly different indicia locations on flashboard 10. However created, each flashboard 10 will have its unique (or nearly unique) placement of indicia, thus providing preferably different flashboards 10 for each player and different outcomes for each machine. For example, while square 32 on player one's flashboard might have a Club suit indicia and a Six value indicia, square 32 on player two's flashboard might have a Heart suit indicia and a Queen value indicia. Thus, the calling of ball/number 32 will provide player one with a Six of Clubs and player two with a Queen of Hearts.

Figure 1:
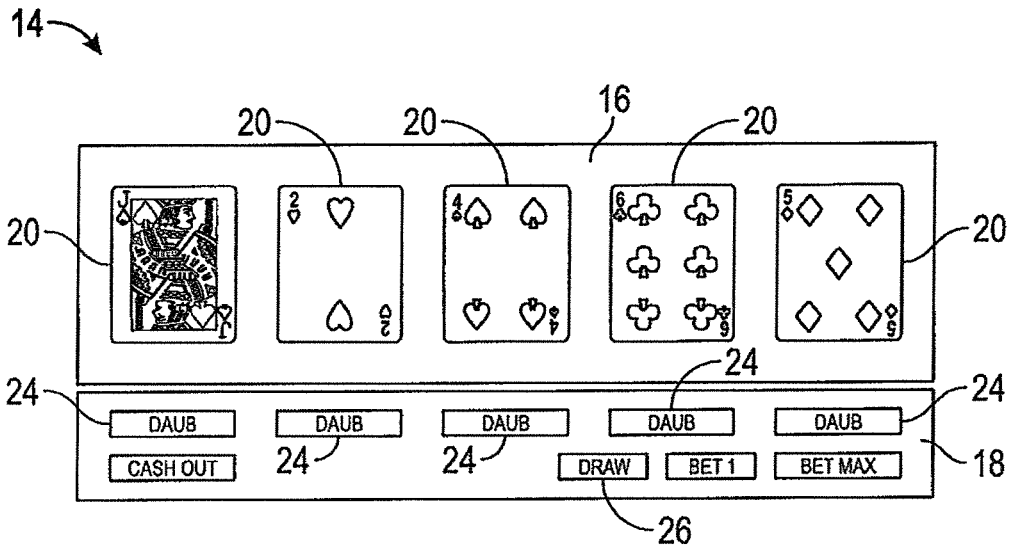
FIG. 1 provides an exemplar of a video terminal, including display screen, of one embodiment of a bingo game of the present invention.
Figure 2:
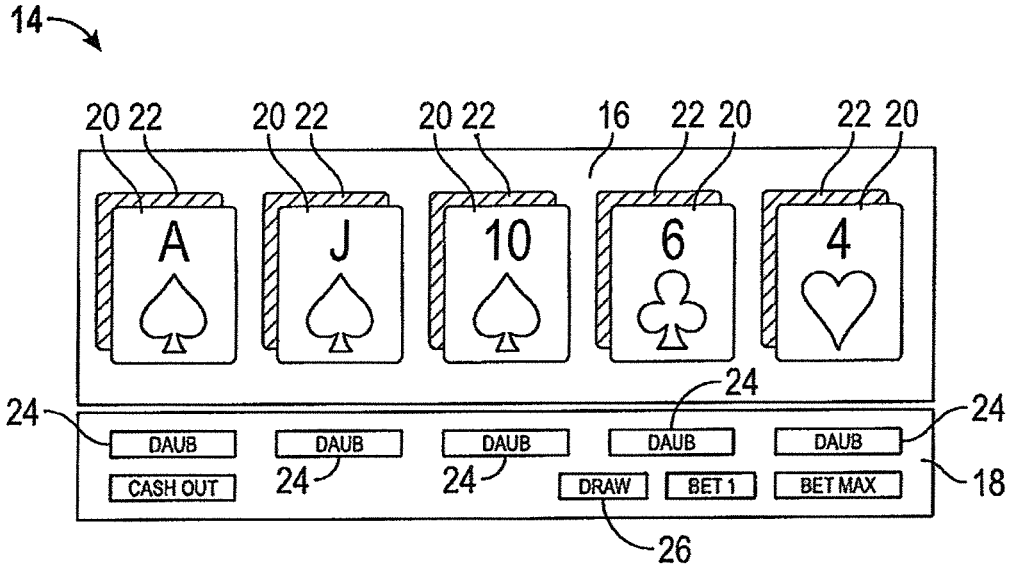
FIG. 2 provides an exemplar of a video terminal, including display screen, of another embodiment of a bingo game of the present invention.

As each ball is drawn and called, the result is electronically communicated to each player machine. (It should be understood that the reference to a ball draw and call is intended to include an electronic draw and an electronic communication of the results of the draw to player machine, and is not meant to be restricted to a manual ball draw or live call by a person.) Referring now to FIG. 1, an exemplar of a player machine 14 is shown. The player machine 14 preferably includes a display screen 16 and a play selection area 18. (It should be understood that the play selection area 18 could be positioned on the player machine 14 separate from the display screen 16 as shown in FIG. 1, or could be displayed on the display screen 16 using touch screen technology or the like.)

Still referring to FIG. 1, the results of the calling of five balls are displayed on the display screen 16, in the form of cards 20 having suit and value indicia corresponding to numbered squares 12 on the flashboard 10. As shown in FIG. 1, the preferred form for displaying the results of the call is in card form, giving the Bingo Poker game the look and feel of a video poker terminal. In the event that the flashboard 10 is also displayed on the display screen 16, it is preferred that upon the calling of each ball, the corresponding square 12 is lit or otherwise modified to indicate that the ball corresponding to that square has been called.

In the preferred embodiment of Poker Bingo, ten balls are called at the beginning of the game. As shown in FIG. 1, only the results for the first five balls will initially be displayed. With respect to the remaining five balls, they are either not initially depicted in any form to the player as shown in FIG. 1, or, referring now to FIGS. 2 and 3, may be represented by an image of a card back 22 or in some other form. (In the event that the flashboard 10 is displayed to the player on the display screen 16, the squares 12 and indicia associated with second group of five balls are not indicated on the flashboard 10 either.)

Each player then electronically daubs those of the first five balls that the player desires to keep by, one card 20 at a time, daubing each card 20 that the player wishes to hold or discard. Daubing is preferably accomplished by the player depressing the daub button 24 for each card to be held—which daub button 24 may be a depressible button or key located in the play selection area 18, a selectable area on a display screen 16 having touch screen capability, or some other vehicle for allowing a player to communicate card selection. (It would also be possible to provide that depression of the daub button 24 would have the effect of highlighting those cards 20 that are to be discarded.)

Once daubing is complete, the player depresses the draw button 26. (It should be noted that the names for the buttons as shown in the drawing figures and as used herein represent examples only, and may be changed as desired.) The undaubed cards 20 are then discarded and replaced with a corresponding number of cards 20 corresponding to balls from the second group of five. If the player daubs (holds) all five cards 20, then no replacement cards are used and the winning hand will be determined using only the original five balls drawn.

There are several possibilities with respect to the manner in which replacement cards 20 are selected from the group corresponding to the second group of five balls. In one embodiment, the machine randomly selects the replacement cards 20 from the second group. In another embodiment, replacement cards 20 are selected from the second group of five balls according to the order in which these balls were called—so that the sixth ball called will be the first replacement, and so on. In yet another embodiment, as depicted for example in FIG. 2, the replacement cards 20 selected will be those corresponding in order to the first five balls selected—so that, for example, the first ball selected will be represented by the first card 20 on the far left side, while the sixth ball selected will be represented by the card back 22 positioned behind the first card 20 on the far left side, and so on.

Figure 3:
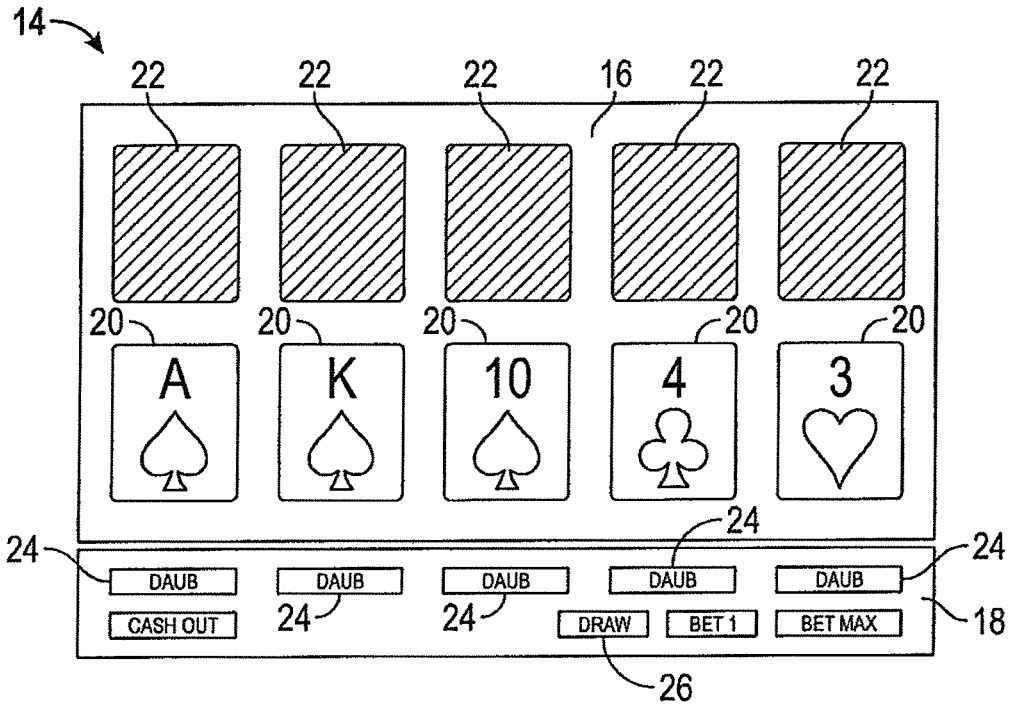
FIG. 3 provides an exemplar of a video terminal, including display screen, of yet another embodiment of a bingo game of the present invention.

In still another embodiment, as depicted for example in FIG. 3, the player can select which replacement cards 20 will be revealed from a row of card backs 22 shown on the display screen. Selection may be accomplished, if touch screen technology is employed, by the player touching the desired card backs 22. Alternatively, the player may depress the daub button 24 associated with the desired card back 22—which, in the configuration shown in FIG. 3, would be the daub button 24 positioned directly below the desired card back 22—revealing each replacement card 20.

It should be noted that the Bingo Poker game and method of the present invention may be adapted to play poker or other card games according to the rules for the particular game. For example, in one variation, only five balls would be drawn, and there would be no replacement balls. Based on the hand produced by the five called balls, the player receives any payout to which he or she is entitled. (Such a game might have the appearance of that shown in FIG. 1.) This variation is similar to 5 card stud poker, in which a player is paid according to a pay table without any replacement cards being available.

In another variation, seven balls are called and, again, there are no replacement balls. Based on the best hand produced by any five of the seven called balls, the player receives any payout to which he or she is entitled. This variation is similar to 7 card stud poker.

Examples of other poker games that could be played using this method would include Triple Play®, bonus poker, Caribbean Stud Poker®, holdem poker, and Double Down Stud®. The present invention could also be utilized to play card games other than poker.

Still other variations are possible to the basic components of the bingo game as discussed above. For example, it would be possible to add a 53rd ball as well as a corresponding 53rd square on the flashboard 10, with the 53rd square representing a wild card or joker. If called, the wild card could be used by the player to represent any suit/value indicia combination that increases the payout to the player.

It would also be possible to provide fewer squares 12 than balls, with an individual square 12 having more than one set of value and suit indicia. If, for example, a particular square 12 had two sets of value and suit indicia, the calling of the ball corresponding to that square 12 would result in an extra card being dealt to the player. The player could either be permitted to keep the extra card or the option of selecting between the two cards corresponding to the square 12, increasing the player's winning prospects. Other variations are also possible.

Another embodiment of the present invention addresses the problem presented by a single ball draw. In this embodiment, overlapping ball draws—possibly though not necessarily from multiple locations—are provided, allowing the playing of overlapping games. For example, if a game takes two minutes to play, a new draw could commence every thirty seconds. Fast player one and slower player two each begin the same game at 1:00 p.m., which game is started by ball draw one. Fast player one, upon finishing the game at 1:00:45 p.m., can participate in a second game, started by a ball draw commencing at 1:01:00 p.m.—even before the first game has closed at 1:02 p.m. Meanwhile, player two can finish his game using all of the allotted time until 1:02 p.m., and participate in a new game commencing at 1:02:00 p.m. or 1:02:30 p.m., etc. Of course, the actual frequency and method of overlapping ball draws can be varied as desired.

One advantage of the multiple ball draw is that the duration of each bingo game can be increased over prior art games, since there is no need to maximize the amount of games that one single ball drawing source can generate. Thus, it can be seen that with multiple ball draws, the needs of slow and fast players can be accommodated. Slow players can play games with longer closing times, so that they can complete their play. On the other hand, fast players can follow one game immediately with another. It should be noted that the multiple ball draw disclosed herein could be incorporated into any bingo-style electronic game—including prior art games currently practiced using a single ball draw—and not only with bingo-style games otherwise described herein.

Bingo rules often require the disclosure to all players at the end of each game how many players were winners in each game and how much they won. This information can be provided in a small square preferably at the bottom of the screen. In one embodiment, the five previous game winners will be disclosed at the bottom of the screen—although more or less than this could be shown. This allows the slower player to take his or her time and to have his or her potential winnings posted before the game is closed.

In another embodiment of the present invention, the rules of bingo can be adopted to provide an electronic game having the look and feel of a video slot machine, and includes on the display a plurality of reels. This game is referred to herein as "Bingo Slots." As with Bingo Poker, in Bingo Slots, each player is provided with at least one flashboard, which flashboard may or may not be displayed on the player's display screen. The flashboard should comprise individual squares having therein at least one indicia—including for example cherries, plums, bells, bars, blanks and other indicia of the type often seen on slot machines—corresponding to the number of bingo balls to be drawn. For example, if there are 90 balls (numbered 1-90), the flashboard should have 90 "squares," numbered 1-90, having indicia therein. (As discussed above, it would be possible to provide a noncorresponding number of flashboard squares and balls.)

Preferably, three balls will be called in a game (i.e., one ball for each reel)—although games with less or more balls may also be played. When the balls are called, the values are communicated to each player machine and the corresponding values on each player flashboard are displayed in any desired format—such as squares or rectangles having images of the indicia therein or thereon. Preferably, the display will have the look and feel of prior art slot machine reels.

Although each player has the same indicia values on his or her flashboard (e.g., 20 cherries, 20 bars, 10 blanks, 10 plums, 30 bells)—each player should have these indicia arranged on the flashboard in a unique or nearly unique manner, so that outcomes among players will be unique or nearly unique. For example, squares 15, 25, and 35 on player one's flashboard might all be cherries, while these squares on player two's flashboard are a cherry, plum, and bar, respectively. There can of course be instances wherein a single machine has multiple type slot games to choose from and individual games can have varying degrees of difficulty. An example of these slot games are "Double Diamond®", "Red, White & Blue®", "Triple Diamond®", "Wheel of Fortune®", "Elvis®", "Betty Boop®" "Slotto®", "Pink Panther®", "Reel 'Em In®", "Monopoly®", "Jackpot Party®", "Addams Family®", "I Dream of Jeannie®" and "Battleship®". The payout will be a function of the difficult of achieving a desired combination, based on the frequency with which a particular value appears on the flashboard.

While it would be possible to provide a single flashboard from which three indicia will be selected as described herein, it would be preferred to provide multiple flashboards per player machine, and preferably one flashboard for each reel in a Bingo Slot game. Thus, if there are three reels, three flashboards are preferably provided. In this manner, the odds of achieving a particular winning combination can be increased exponentially, creating the possibility of relatively large payouts and thus increasing player excitement. Similarly, the number of balls/flashboard squares can be varied as desired to achieve desired game probabilities.

As shown in the following table, the use of multiple flashboards and the variation in the number of balls can substantially alter slot odds:

| Number of Reels | Number of Balls | Slot Odds - One bar per reel |
|---|---|---|
| 1 | 75 | 75 to one |
| 1 | 90 | 90 to one |
| 1 | 105 | 105 to one |
| 2 | 75 | 5,625 to one |
| 2 | 90 | 8,100 to one |
| 2 | 105 | 11,025 to one |
| 3 | 75 | 421,875 to one |
| 3 | 90 | 729,000 to one |
| 3 | 105 | 1,157,625 to one |
| 4 | 75 | 31,640,625 to one |
| 4 | 90 | 65,610,000 to one |
| 4 | 105 | 121,550,625 to one |

Of course, the numbers 75, 90 and 105 are meant to be exemplary only, and the actual number of balls used could be varied as desired.

Figure 5:
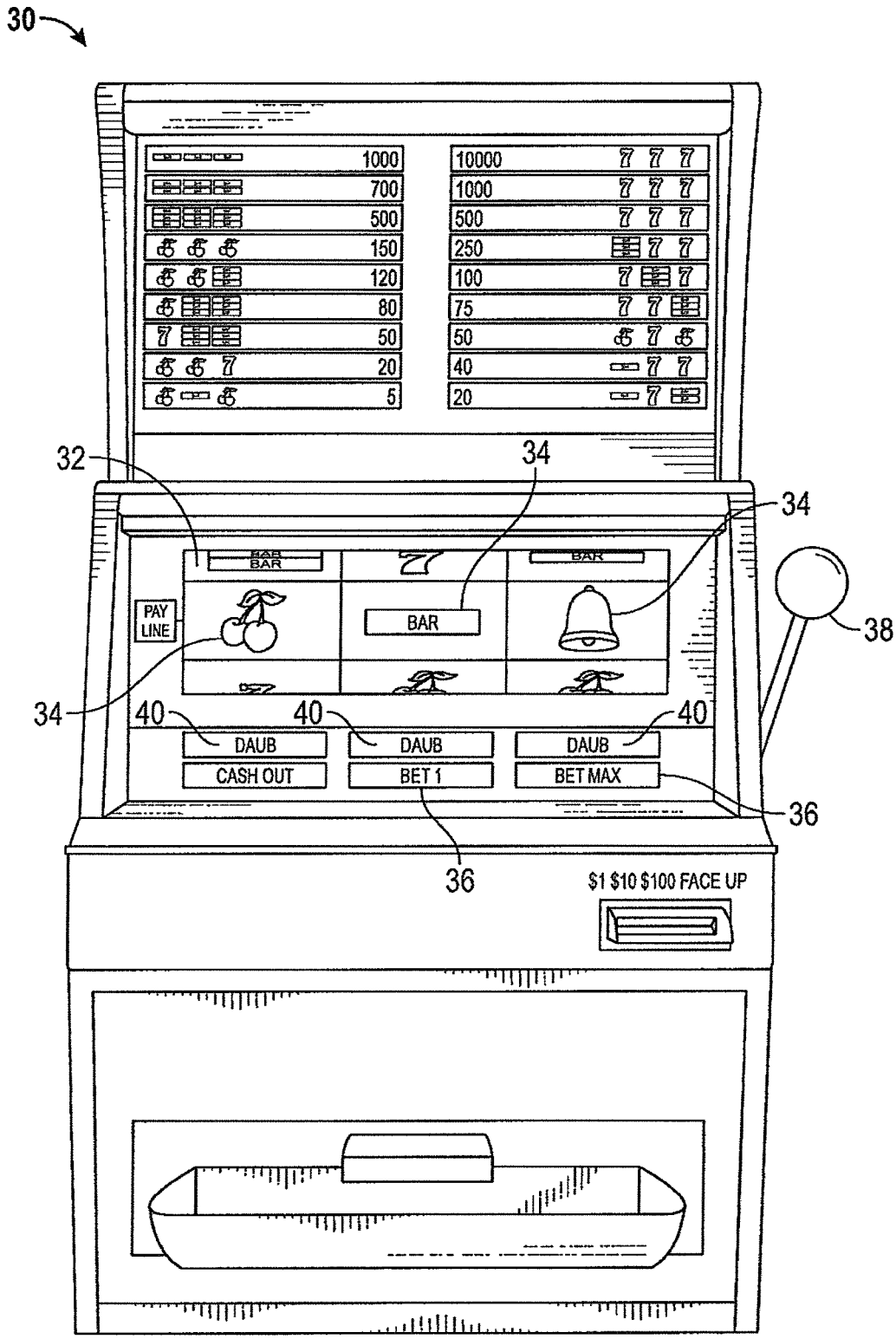
FIG. 5 provides an exemplar of a video terminal, including display screen, of still another embodiment of a bingo game of the present invention.

Referring now to FIG. 5, an exemplar of a video terminal 30 embodying the Bingo Slots variant of the present invention is shown. The video terminal 30 includes a display screen 32, on which is displayed the indicia 34 from the flashboard squares corresponding to the called balls. To use the video terminal 30, a player will place his or her bet using one of the betting keys 36. The player then commences play and accesses the results of the ball draw by pulling the handle 38. The results of the ball draw are then displayed on the display screen 32. To complete play, and consistent with the rules of bingo, the player daubs the indicia 34 appearing on the display screen 32 by depressing the daub keys 40—or by daubing in some other designated manner.

Of course, the features of the video terminal 30 may be altered in any desired fashion. For example, the handle 38 may be replaced with a button, touch screen icon, or other means for commencing play. One daub key 40 could be used in place of individual daub keys 40 for each indicia 34 displayed. It would also be possible to display more than one row of indicia 34 for double, triple, nine-line, etc. play. Still further, it would be possible to substitute a machine having mechanical reels for the video terminal 30 and still be within the scope of the present invention.

Referring now to FIGS. 6-14, another embodiment of the bingo game of the present invention having the look and feel of video poker is shown. For ease of reference, this game will be referred to as "Bingo Poker" herein. The Bingo Poker game is similar to the previous embodiments so differences will be discussed below.

Figure 6:
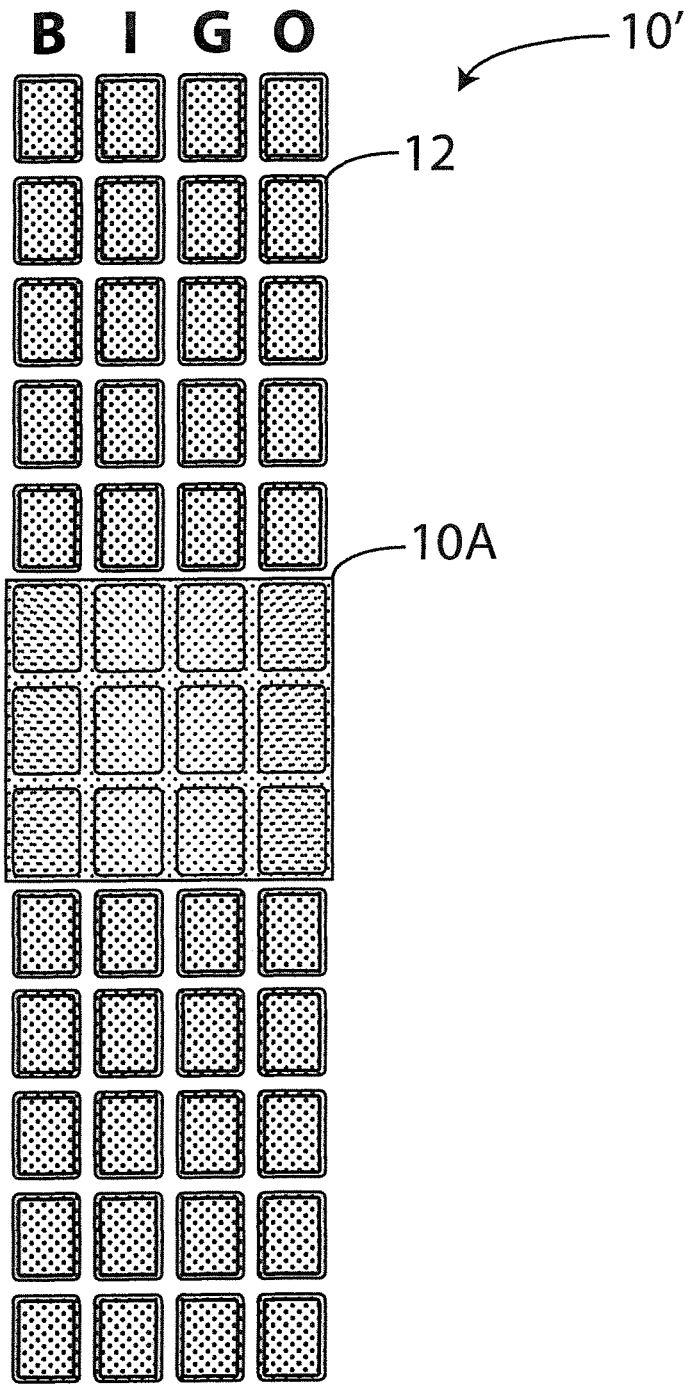
FIG. 6 is a front view of a flashboard used in another embodiment of the bingo poker game of the present invention.

Bingo Poker is a traditional electronic bingo game requiring at least two players to begin where the first player to cover a previously designated bingo pattern (12 spot center box as shown in FIG. 6) on a bingo card 10' wins the game. Draw Poker style bonus prizes may be awarded for creating a winning five card poker hand defined entirely by the spots hit on the player's bingo card 10' within the first ten bingo balls drawn. An additional progressive jackpot bonus prize may be awarded based on a far-miss bingo criterion as will be disclosed below. Like traditional bingo, each player terminal has a unique bingo card and all players in a specific game receive the same ball call.

Figure 14:
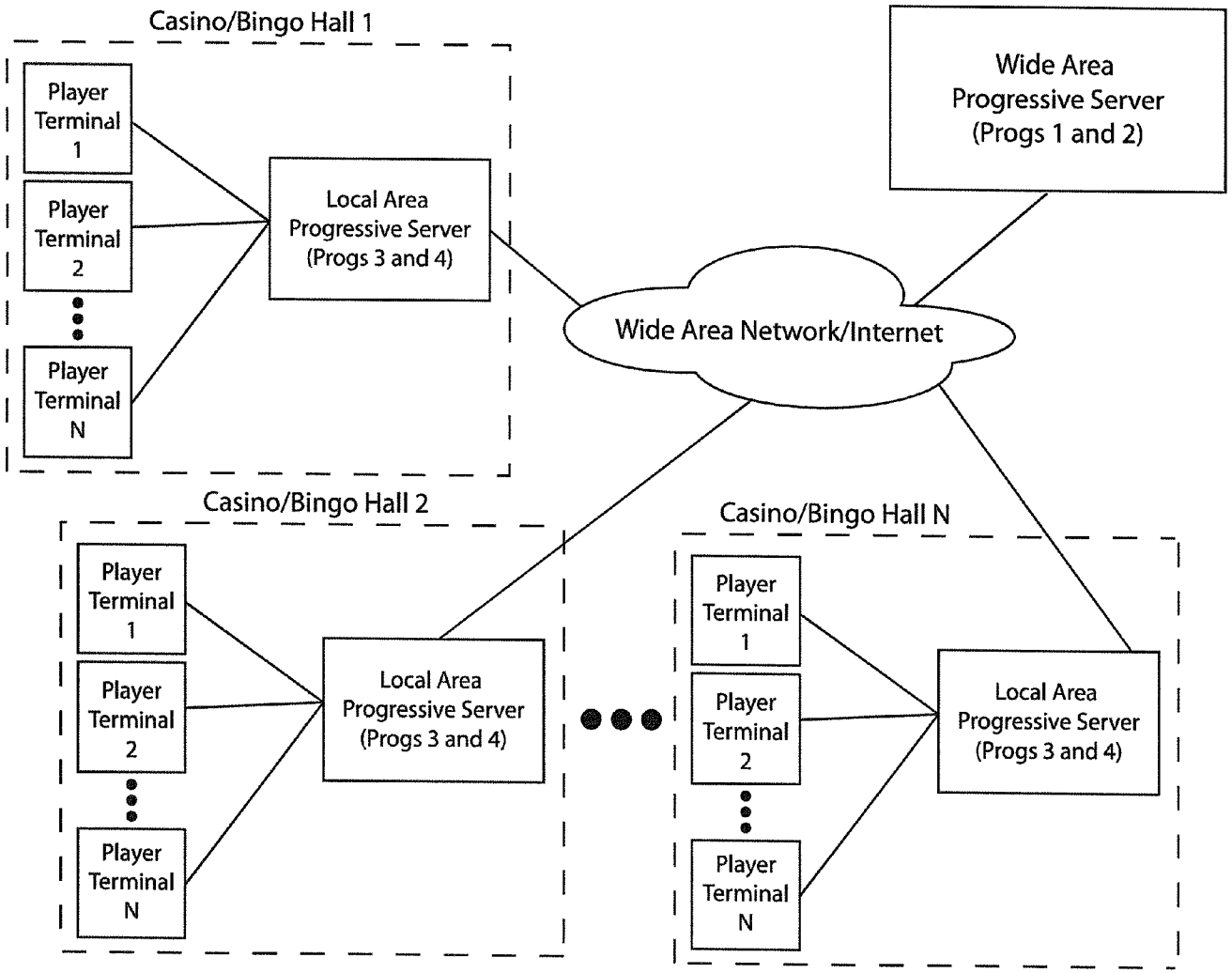
FIG. 14 shows a gaming network implementing the bingo poker game of the present invention.

The game may be facilitated by player terminals providing players with an entertaining interface for interacting with the game, game servers for collecting players into games and delivering game results, and a computer network to facilitate communication between the player terminals and game servers as shown in FIG. 14.

In the present embodiment, Bingo Poker is played similarly to a traditional bingo game where a series of balls are drawn from a 52 ball population and matched by players to bingo cards 10' with the goal of being the first player to achieve a pre-designated game ending bingo pattern 10A (12 spot center box). Other designated game ending bingo patterns may be used without departing from the spirit and scope of the present invention.

Each player has a single, unique 4×13 spot BIGO card 10' with no free space where the numbers 1-13 are placed in random order in the 1$^{st}$ column labeled "B", 14-26 are randomly ordered in the second ("I") column, 27-39 are randomly ordered in the third ("G") column, and 40-52 are randomly ordered in the fourth ("0") column.

In accordance with one embodiment, Bingo Poker may use a unique dual perm system for generating bingo cards 10' for the game. Each player is assigned a 52 spot bingo card at the beginning of the game session that may be used for each game played unless the player chooses to swap cards between games by touching the bingo card 10'. Each 52 spot bingo card is dealt in order from a shuffled card perm of tens of thousands to hundreds of thousands of pre-generated bingo cards selected to minimize the probability of multiple players achieving game ending patterns or progressive jackpot prizes on the same ball, thus resulting in split prizes.

In addition to the persistent bingo card, a second, 52 spot poker card overlay is dealt to each player immediately after a minimum number of players has been established for each game and immediately prior to the first ball being called. Although in some instances the overlay may be generated after the first ball is drawn. This secondary card consists of all 52 playing card faces from a standard deck of 4 suits (hearts, diamonds, spades, and clubs) numbered 2 through 10 and J, Q, K, and A. These overlay cards are dealt in order from a card permutation selected to insure all poker hands have probabilities of being achieved equal to those of a randomly generated draw poker game. For games that require two or more decks, multiple overlay perms could be used with the persistent bingo card, with all perms using the same ball draw. Random number generators may be used in lieu of perms if permitted by gaming regulators.

The bingo poker game consists of a buy in period, an initial ball call (5 balls), a final ball call, and a prize awarding period.

The buy in period remains open until at least 2 players have joined the game or a configurable amount of time expires resulting in no game played and a refund of the purchase. A player joins the game by selecting a buy in amount and pressing the "Deal" button 50. A game will begin as soon as at least two players have purchased bingo cards 10' within the buy in period. Bingo cards 10' cost a minimum of 1 credit and a maximum of 5 credits. Players can be grouped together in games regardless of the price of the card purchased.

Multiple games with overlapping buy in periods may be offered to minimize player wait time between games. Players can be grouped within a single facility or across multiple facilities to efficiently build adequate minimums to start each game.

The initial ball call begins upon the buy in period closing. Five balls are delivered to the player terminal and displayed in the order they were drawn in the ball call display area 52 and displayed on the appropriate squares 12 on the bingo card 10'.

Upon the player pressing the "Draw" button 54, the remaining balls are revealed to the player and displayed in the order they were drawn in the ball call display area 52 and on the appropriate matching squares on the bingo card 10'. The "Draw" button 54 serves multiple functions including daubing the first 5 balls, revealing and daubing the remaining balls, and claiming any prizes that are won as a result of the game. The number of balls in the final ball call is variable depending on the number of balls required for the first card participating in the current game to achieve the game ending bingo pattern.

Figure 7:
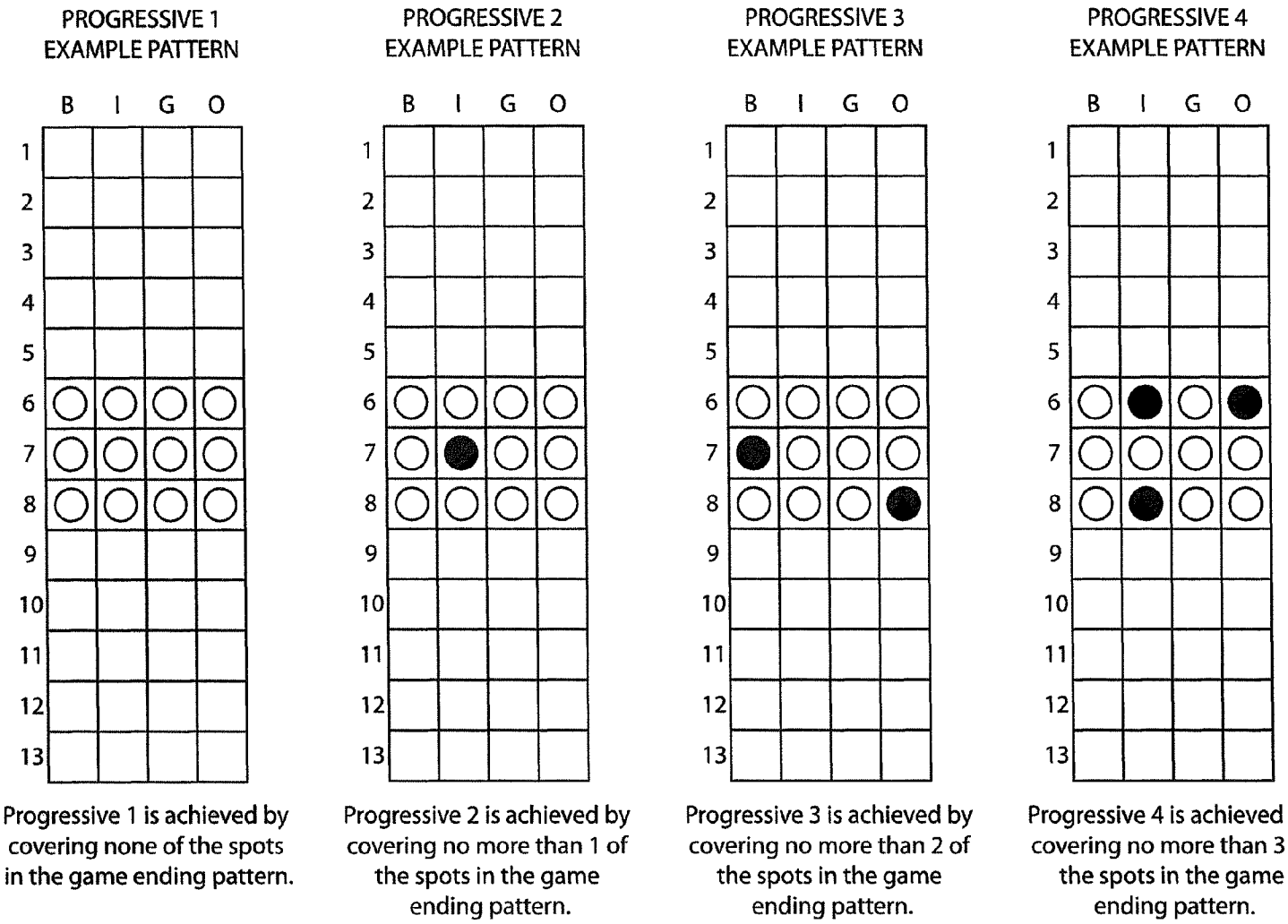
FIG. 7 is a front view of a flashboard showing embodiments of different progressive winning patterns.

Prizes are awarded immediately after the final ball call is displayed for any player that has achieved the game ending bingo pattern and for bonus prizes. In accordance with the present embodiment, there are three types of prizes in Bingo Poker as shown in FIG. 7:

1) Game Ending Bingo Prize—The game ending prize is a minimum of 1 cent or a pre-configured percentage of the players bet (whichever is larger) awarded for the first player to achieve the game ending bingo pattern.
2) Far-miss Bingo Progressives—The far-miss bingo progressives are one or more bonus prizes awarded to player or players with few spots marked in the game ending pattern at the time the game ends due to another player achieving the game ending pattern. If two or more players achieve the jackpot in the same game, all players will split the progressive jackpot prize. The current game design supports up to four far-miss progressives, but only three are being used.
   a. Progressive 1: Mega Jackpot Wide Area Progressive—This progressive is won by the player with no spots covered in the game ending pattern at the time the game ends.
   b. Progressive 2: Super Jackpot Wide Area Progressive—This progressive is won by the player with only 1 spot covered in the game ending pattern at the time the game ends.
   c. Progressives 3 and 4: Local Area Jackpots (optional)-One or both of these progressives can be activated by the local operator by configuring a win criteria based on the number of spots away from achieving a game ending bingo, similar to progressives 1 and 2. The current game design leverage progressive 3 as a far-miss, local area progressive won by having only 2 hits in the game ending pattern at the time the game ends.
3) Poker Bonus Prizes—The poker bonus prizes are determined based on the poker hand achieved by the player during the course of the bingo game according to the poker paytable discussed below and shown in FIG. 8. It would also be possible to require the players to make a separate wager to qualify for the progressive jackpot(s).

The draw poker game is a secondary bonusing mechanism based entirely on the spots marked on each player's bingo card 10', but uniquely incorporating the player's skill at making a winning poker hand for determining bonus prizes.

After the buy in period has closed and prior to the first ball being delivered to the player terminal, a secondary bingo card consisting of 52 playing card faces from a separate card perm is delivered to each player and displayed face down (only card backs 56 showing) on top of the player's traditional bingo card. This secondary bingo card creates a unique bingo card to playing card mapping for each player.

Immediately following the delivery of the secondary poker overlay card and the initial ball draw, the playing card corresponding to the spot marked on the bingo card for each of the first 5 balls drawn is displayed in order on the player's game screen 58. This grouping of 5 cards is equivalent to the "deal" hand in a draw poker game.

The player touches between 0 and 5 cards to be kept for the final poker hand. After selecting the cards to be kept (or no cards to be kept), the player presses the "Deal/Daub" 50 button to swap any cards that were not daubed and to reveal any prizes won by the poker game. Cards are swapped in order based on the $6^{th}$-$10^{th}$ balls called beginning with card face corresponding to the $6^{th}$ ball replacing the first card swapped (not kept) and continuing through the playing cards corresponding with the $7^{th}$, $8^{th}$, $9^{th}$, and $10^{th}$ balls drawn as required to replace the remaining swapped cards.

Figures 8, 9:
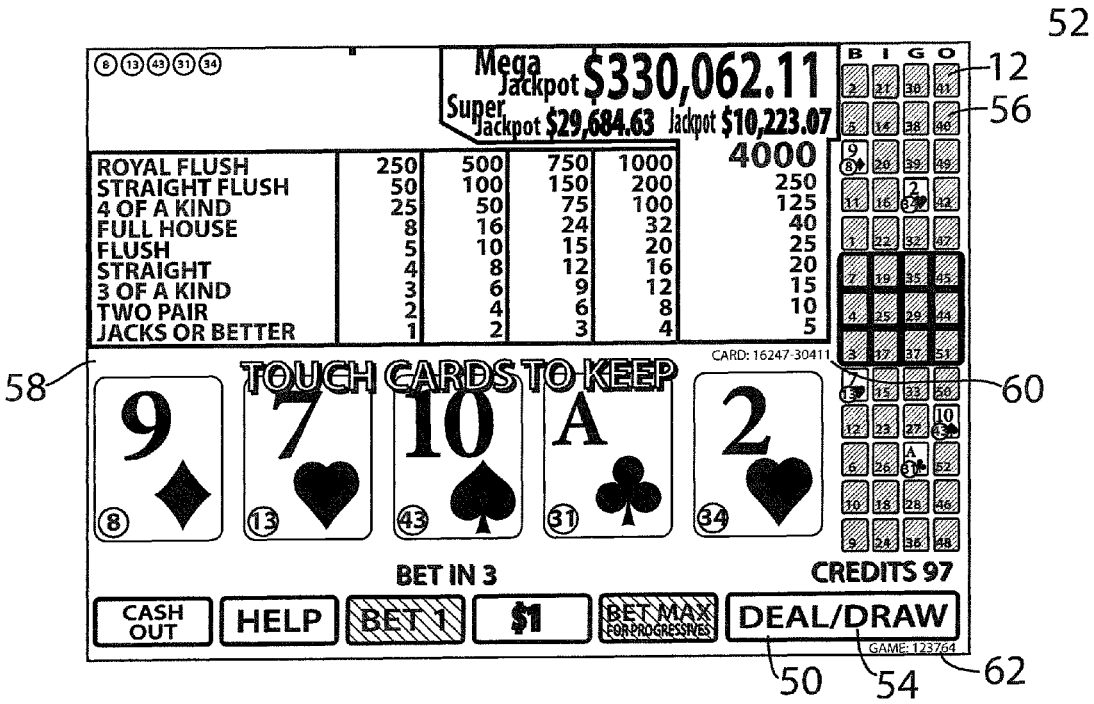
FIG. 8 shows a front view of a sample draw poker paytable for the bingo poker game of the present invention.
FIG. 9 shows a front view of an initial ball call state for the bingo poker game of the present invention.
Figure 10:
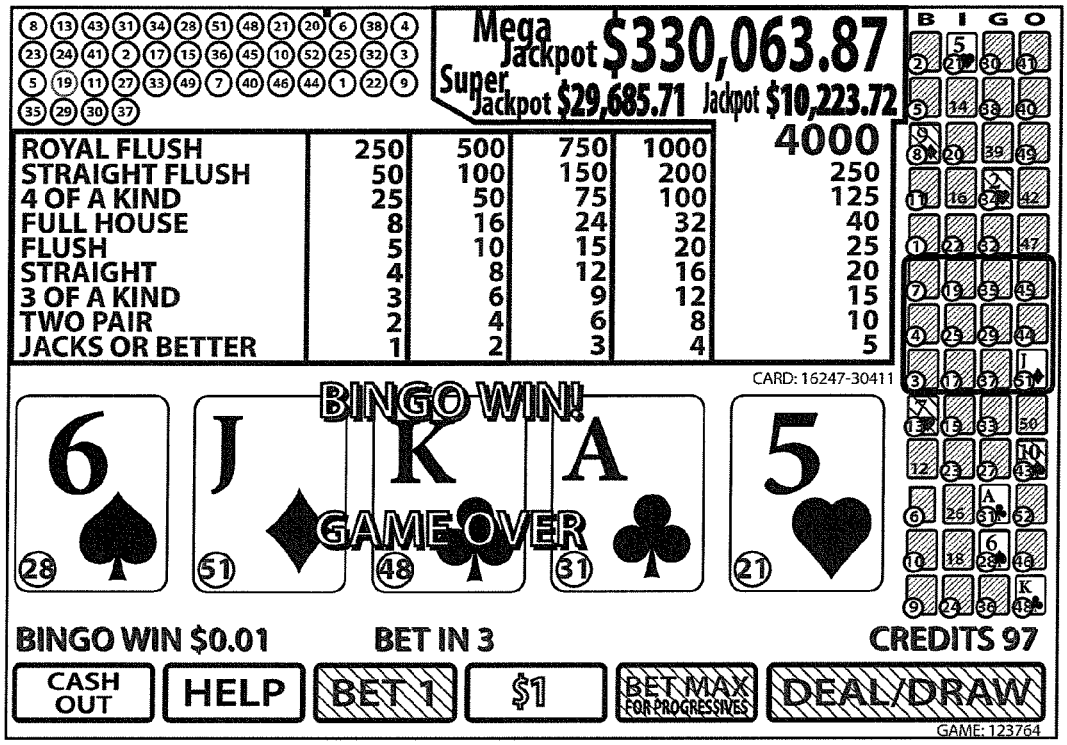
FIG. 10 shows a front view of a game over state-bingo win for the bingo poker game of the present invention.
Figure 11:
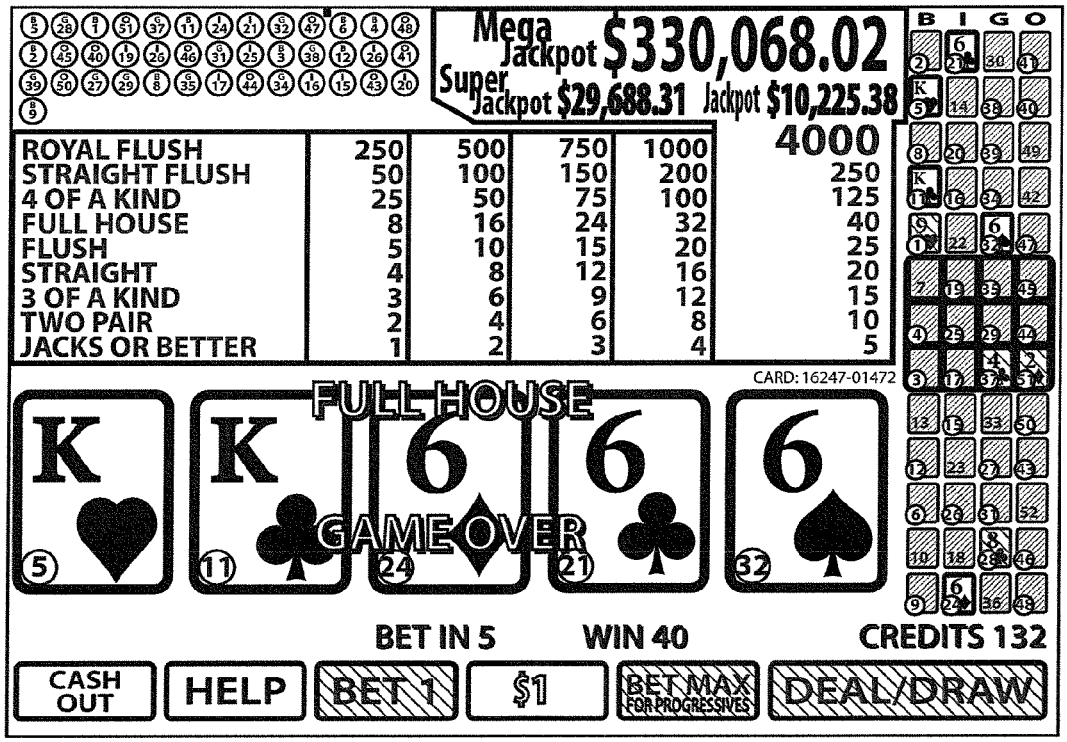
FIG. 11 shows a front view of a game over state-poker win for the bingo poker game of the present invention.
Figure 12:
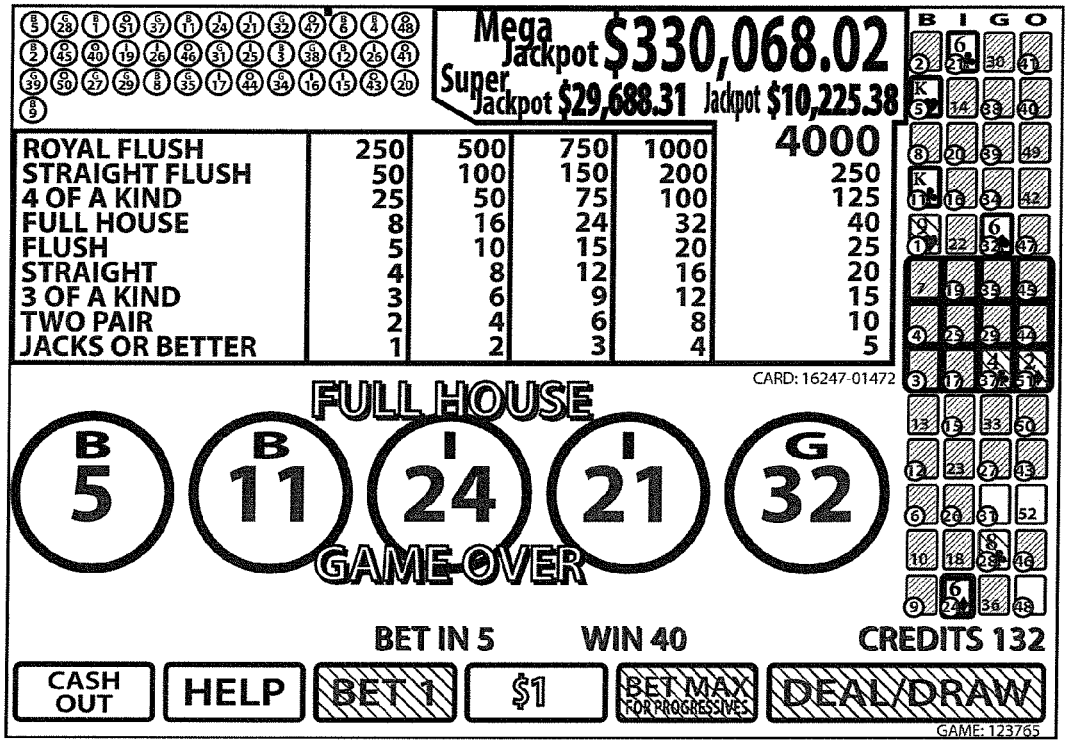
FIG. 12 shows a front view of game over state-poker win (No Card Display) for the bingo poker game of the present invention.
Figure 13:
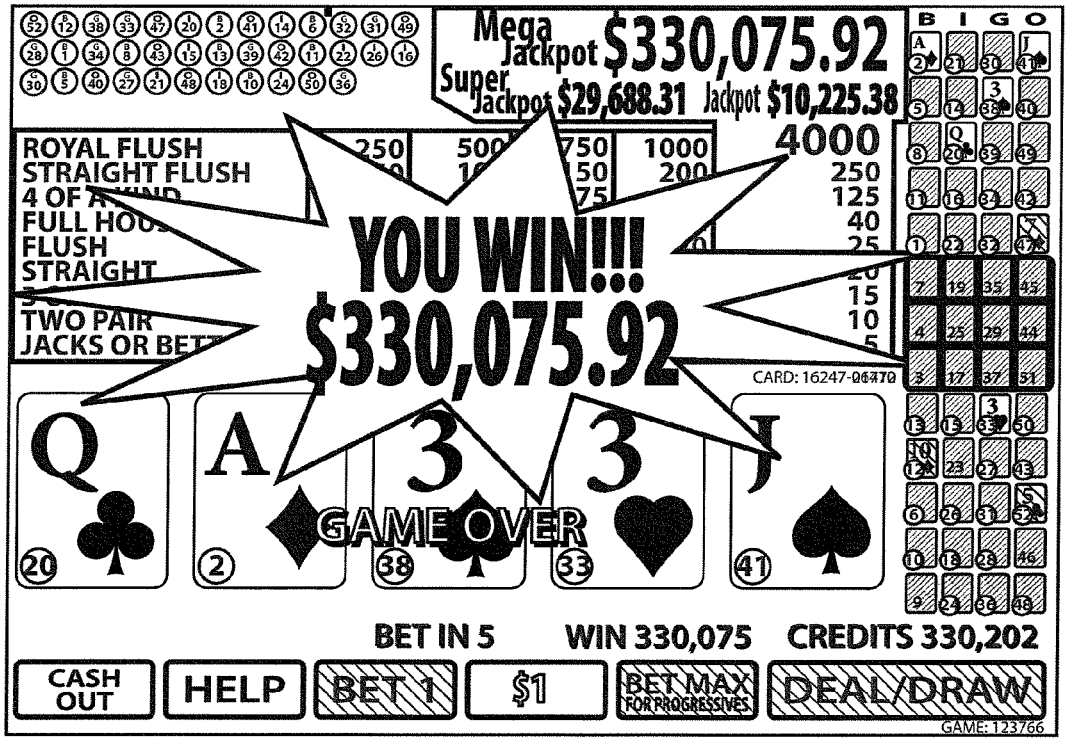
FIG. 13 shows a front view of a game over state-progressive win for the bingo poker game of the present invention.

Prizes are awarded at the conclusion of the bingo game based on the poker hand created by each player according to the poker paytable. An example of a typical draw poker paytable is shown in FIG. 8.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A video gaming system comprising a processor for executing program instructions and a memory coupled to the processor for storing the program instructions, the programming instructions comprising:

providing each player with an individual flashboard, each flashboard having an equal number of spaces, each space defined by a column label and a space number, wherein the space number is randomly selected from a predefined number range for each column;

providing indicia for each space on each flashboard, wherein the indicia comprises each of suit and value indicia, the indicia randomly generated by the video gaming system;

providing a plurality of bingo balls for common use for all players, wherein each bingo ball has markings associated with one of the plurality of spaces, a total number of bingo balls corresponding to a number of the plurality of spaces on an individual flashboard;

randomly selecting a first group of bingo balls for common use for all players;

displaying to each player the markings associated with each selected bingo ball of the first group of bingo balls;

marking each square associated with each of the first group of bingo balls on each individual flashcard, displaying the indicia associated with each of the numbered space corresponding to each selected bingo ball of the first group of bingo balls on each individual flashcard;

selecting desired indicia to be kept by each player;

randomly selecting a second group of bingo balls for common use for all players;

swapping the indicia associated with each of the numbered space corresponding to each non-selected bingo ball on each flashcard;

displaying the indicia associated with a first set of bingo balls of the second group of bingo balls corresponding to each of the non-selected bingo ball on each flashcard;

marking each square associated with each of the first set of bingo balls from the second group of bingo balls on each individual flashcard;

displaying to each player the markings associated with a second set of bingo balls from the second group of bingo balls selected until a predetermined pattern is marked on one of the players flashcard;

determining if remaining indicia for each player is a winning combination based on a poker pay table associated with the video game system; and awarding prizes to a first player having the predetermined pattern marked on the individual flashcard and any player having no markings on the predetermined pattern after the first player achieves the predetermined pattern.

2. The video gaming system of claim 1, wherein the program instructions further comprises randomly selecting the first group of bingo balls wherein the first group of bingo balls comprises five bingo balls.

3. The video gaming system of claim 1, wherein the program instructions further comprises randomly selecting the second group of bingo balls wherein the second group of bingo balls comprises five bingo balls.

4. The video gaming system of claim 1, further comprising awarding prizes any player having only one marking on the predetermined pattern after the first player achieves the predetermined pattern.

5. The video gaming system of claim 1, wherein the program instructions further comprises determining any other bingo progressive winners.

6. The video gaming system of claim 1, wherein the program instructions further comprises determining any other bingo progressive winners, wherein bingo progressive winners are awarded to a player with predetermined markings in a game ending pattern when the game ends due to the first player achieving the desired game ending pattern.

7. The video gaming system of claim 1, wherein the program instructions further comprises a first bingo game commences with said randomly selecting said first group of said bingo balls, wherein a second bingo game commences with said randomly selecting said second group of bingo balls, and further comprising the steps of allowing said first game of bingo to proceed for a specified period of time prior to closing, and wherein said second bingo game commences prior to said closing of said first bingo game.

8. A video gaming system comprising a processor for executing program instructions and a memory coupled to the processor for storing the program instructions, the programming instructions comprising:

providing each player with an individual flashboard, each flashboard having an equal number of spaces, each space defined by a column label and a space number, wherein the space number is randomly selected from a predefined number range for each column;

providing a plurality of bingo balls for common use for all players, wherein each bingo ball has markings associated with one of the plurality of spaces, a total number of bingo balls corresponding to a number of the plurality of spaces on an individual flashboard;

randomly selecting a first group of bingo balls for common use for all players;

displaying to each player the markings associated with each selected bingo ball of the first group of bingo balls;

marking each square associated with each of the first group of bingo balls on each individual flashcard;

determining any winning flashboard;

providing indicia for each space on each flashboard, wherein the indicia comprises each of suit and value indicia, the indicia remaining hidden;

displaying the indicia associated with each said numbered space corresponding to each selected bingo ball on each flashcard;

randomly selecting a second group of bingo balls for common use for all players;

selecting desired indicia to be kept by each player; and swapping the indicia associated with each said numbered space corresponding to each non-selected bingo ball on each flashcard;

displaying the indicia associated with each said numbered space corresponding to each selected bingo ball of the second group of bingo balls;

determining if remaining indicia for each player is a winning combination based on a poker pay table associated with the video game system; and awarding prizes to a first player having the predetermined pattern marked on the individual flashcard and any player having no markings on the predetermined pattern after the first player achieves the predetermined pattern.

9. The video gaming system of claim 8, wherein the program instructions further comprises randomly selecting the first group of bingo balls wherein the first group of bingo balls comprises five bingo balls.

10. The video gaming system of claim 9, wherein the program instructions further comprises randomly selecting the second group of bingo balls wherein the second group of bingo balls comprises five bingo balls.

11. The video gaming system of claim 8, wherein the program instructions further comprises determining any other bingo progressive winners.

12. The video gaming system of claim 8, wherein the program instructions further comprises determining any other bingo progressive winners, wherein bingo progressive winners are awarded to a player with predetermined markings in a game ending pattern when the game ends due to another player achieving the desired game ending pattern.

13. The video gaming system of claim 8, wherein the program instructions further comprises a first bingo game commences with said randomly selecting said first group of said bingo balls, wherein a second bingo game commences with said randomly selecting said second group of bingo balls, and further comprising the steps of allowing said first game of bingo to proceed for a specified period of time prior to closing, and wherein said second bingo game commences prior to said closing of said first bingo game.

14. A video gaming system comprising a processor for executing program instructions and a memory coupled to the processor for storing the program instructions, the programming instructions comprising:

providing each player with an individual flashboard having a plurality of spaces, each space defined by a column label and a space number, wherein the space number is randomly selected from a predefined number range for each column, each space further having indicia wherein the indicia comprises each of suit and value indicia, the indicia being hidden from view;

providing a plurality of bingo balls for common use for all players, wherein each bingo ball has markings associated with one of the plurality of spaces, a total number of bingo balls corresponding to a number of the plurality of spaces on an individual flashboard;

randomly selecting a first group of bingo balls for common use for all players;

displaying to each player the markings associated with each selected bingo ball of the first group of bingo balls;

marking each square associated with each of the first group of bingo balls on each individual flashcard;

randomly selecting a second group of bingo balls for common use for all players;

selecting desired indicia to be kept by each player;

swapping the indicia associated with each said numbered space corresponding to each non-selected bingo ball on each flashcard;

displaying the indicia associated with each said numbered space corresponding to each selected bingo ball of the second group of bingo balls before determining winning player indicia combination;

determining any winning flashboard, wherein a winning flashboard is a first player to achieve a desired pattern on the flashboard;

determining any bingo progressive winners, wherein bingo progressive winners are awarded to a player with predetermined markings in a game ending pattern when the game ends due to another player achieving the desired game ending pattern;

displaying the indicia associated with each said numbered space corresponding to each selected bingo ball on each flashcard; and determining winning player indicia combination.

15. The video gaming system of claim 14, wherein the program instructions further comprises randomly selecting the first group of bingo balls wherein the first group of bingo balls comprises five bingo balls.

16. The video gaming system of claim 15, wherein the program instructions further comprises randomly selecting the second group of bingo balls wherein the second group of bingo balls comprises five bingo balls.

* * * * *

UNITED STATES PATENT AND TRADEMARK OFFICE

CERTIFICATE OF CORRECTION

PATENT NO. : 8,752,838 B2
APPLICATION NO. : 13/495259
DATED : June 17, 2014
INVENTOR(S) : Gary Weingardt, Gamin Weingardt and Gary Lee Loebig It is certified that error appears in the above-identified patent and that said Letters Patent is hereby corrected as shown below:

In the Specification

Column 7, line 12, delete "difficult" and insert -- difficulty --.

In the Claims

Claim 4, column 11, line 40, delete "prizes any" and insert -- prizes to any --.

Signed and Sealed this
Sixteenth Day of December, 2014

Michelle K. Lee

Michelle K. Lee
*Deputy Director of the United States Patent and Trademark Office*